US006990703B2

(12) United States Patent
Brown et al.

(10) Patent No.: US 6,990,703 B2
(45) Date of Patent: Jan. 31, 2006

(54) METHOD OF REPRODUCING, RECOLORING AND/OR RECYCLING CARPET TILES

(75) Inventors: Robert S. Brown, LaGrange, GA (US); William D. Blackstock, LaGrange, GA (US); Kazufumi Yamada, Yonezawa (JP); E. Wayne Hunter, LaGrange, GA (US); Nobuki Katayama, Yonezawa (JP)

(73) Assignee: Milliken & Company, Spartanburg, SC (US)

( * ) Notice: Subject to any disclaimer, the term of this patent is extended or adjusted under 35 U.S.C. 154(b) by 477 days.

(21) Appl. No.: 09/920,152

(22) Filed: Aug. 1, 2001

(65) Prior Publication Data

US 2002/0074075 A1 Jun. 20, 2002

Related U.S. Application Data

(60) Provisional application No. 60/223,450, filed on Aug. 4, 2000.

(51) Int. Cl.
*D06B 1/02* (2006.01)

(52) U.S. Cl. ..... 8/150; 68/200; 68/205 R

(58) Field of Classification Search ..... 8/150, 8/148; 68/28, 200, 205 R
See application file for complete search history.

(56) References Cited

U.S. PATENT DOCUMENTS 3,010,859 A * 11/1961 Stephens et al.
3,402,094 A * 9/1968 Levitch
3,969,779 A 7/1976 Stewart, Jr. ..... 8/149
4,877,669 A * 10/1989 Endrenyi, Jr. et al.
4,926,520 A * 5/1990 Watson
4,991,307 A 2/1991 Higgins ..... 33/526
5,096,747 A 3/1992 Scholla et al. ..... 427/299
5,116,439 A * 5/1992 Raus
5,324,562 A * 6/1994 Millinax et al.
5,380,561 A 1/1995 Dorn ..... 427/430
5,381,592 A * 1/1995 Higgins
5,457,845 A 10/1995 Higgins et al. ..... 15/302
5,658,430 A * 8/1997 Drake, Jr. et al.
5,763,001 A * 6/1998 Brown

FOREIGN PATENT DOCUMENTS

| | | |
|---|---|---|
| CA | 50162/54 | 6/1990 |
| DE | 19603951 | 8/1997 |
| GB | 1338030 | 11/1973 |
| JP | 4988512 | 8/1974 |
| JP | 5196177 | 8/1976 |
| JP | 52148970 | 12/1977 |
| JP | 8-92880 | * 4/1996 |

* cited by examiner

*Primary Examiner*—Frankie L. Stinson
(74) *Attorney, Agent, or Firm*—Terry T. Moyer; Daniel R. Alexander

(57) ABSTRACT

Reproducing, recoloring and/or recycling of used carpet tiles is provided. In accordance with one embodiment, used carpet tiles, which are recovered, are subjected to a choosing step according to the degree of stains, etc. The chosen carpet tiles are washed with a high-pressure fluid, and entangling of piles is removed and piles raised. The resultant carpet tiles are subjected to a choosing step once again according to the degree of stains, etc. The chosen carpet tiles are treated with such a design and color for recycling as to make less visible the stains or non-uniformity in color remaining after the washing, using a design computer, etc. Thus, reproduced carpet tiles are produced and subjected a choosing step once again, and the chosen ones are shipped.

19 Claims, 10 Drawing Sheets

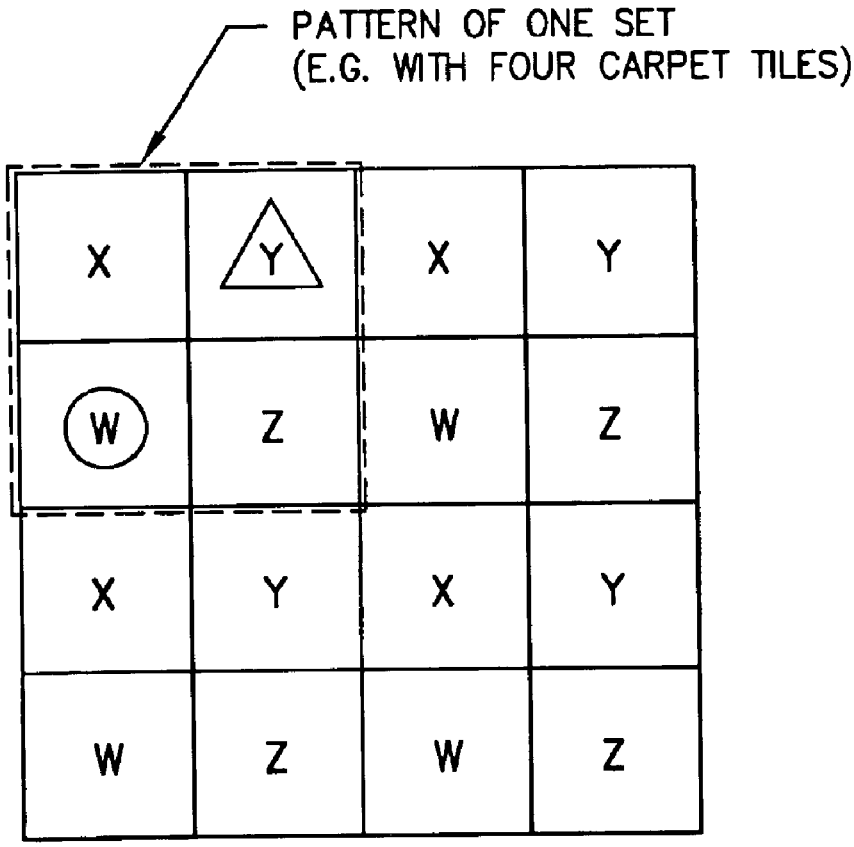
*FIG. —4—*

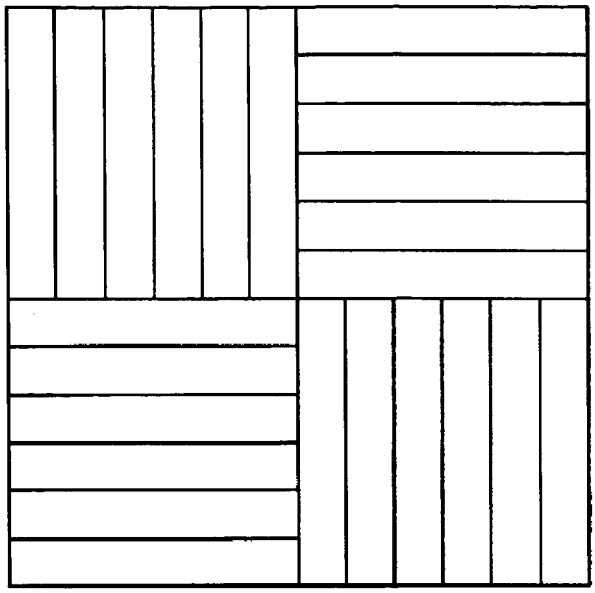
CUTOFF EFFECT BY 90° ROTATION
*FIG. –5–*
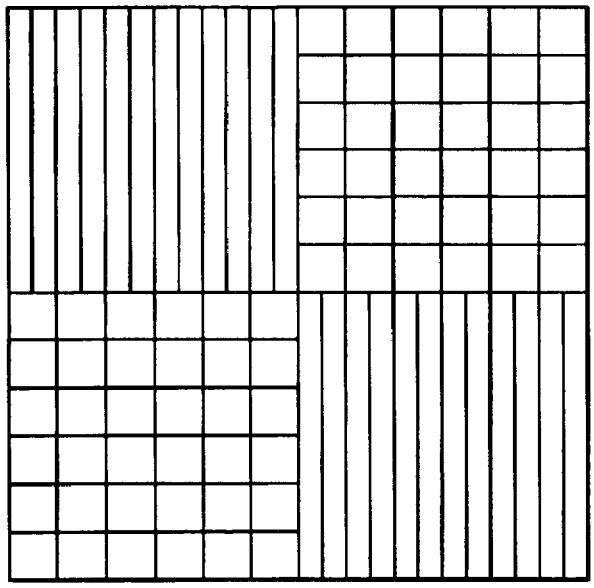
CUTOFF EFFECT BY COMBINATION
OF LARGE AND SMALL PATTERNS
*FIG. –6–*

METHOD OF REPRODUCING, RECOLORING AND/OR RECYCLING CARPET TILES

CROSS-REFERENCE TO RELATED APPLICATIONS

This application claims priority to and the benefit of U.S. Provisional Patent Application Ser. No. 60/223,450, filed on Aug. 4, 2000, hereby incorporated by reference herein.

BACKGROUND OF THE INVENTION

The present invention relates to a method or methods of reproducing, recoloring and/or of recycling used carpet tiles or carpet pieces and products produced by such methods.

In general, carpet tiles conventionally used at various places such as shops and offices are cleaned on a periodic basis. As years go by, however, the carpet tiles become dirty due to mud, sand, dust, dropped or spilled drink and food, resulting in non-uniform colors and stains. In such cases, the old carpet tiles are, as a rule, replaced with new ones, and the former are discarded.

Such replacement of carpet tiles incurs high cost. Not only the cost of new carpet tiles, but also the cost of removal and disposal of the used carpet tiles. Recently, municipalities have added heavy charges for land filling of used carpet tiles.

Also, destructive recycling by, for example, grinding synthetic fiber carpet tile into small chips and using the chips as either fuel, fill, or to be re-extruded as fiber is costly and does not maximize the inherent value of the used carpet tile. Further, the disposal of used carpet tiles by incineration has recently become an environmental concern.

SUMMARY OF THE INVENTION

The present invention has been made in order to solve or at least address the above problems, and at least one object is to provide a method of refurbishing or reproducing carpet tiles, which are not greatly affected by dirt, non-uniformity in color, or stain, and can be put to practical use, and recycling the reproduced carpet tiles. This method provides for non-destructive recycling of the used carpet tiles one or more times before they must be discarded or destructively recycled.

In accordance with one embodiment of the method of the present invention, the process includes the steps of removing, refurbishing (renewing), repatterning, and reinstalling (replacing) used carpet tiles or carpet pieces or sections.

In order to achieve the above object according to one aspect of the invention, there is provided a method of reproducing/recoloring carpet tiles, characterized by:

- a washing/reproducing step of jetting a fluid onto used carpet tiles, thereby to perform cleaning for cleaning dirt and/or stain on the used carpet tiles and to perform retexturing, thus forming reproduced carpet tiles;
- and a recoloring (or patterning) step of recoloring the reproduced carpet tiles with such a design or a color, or both, as to prevent or cover non-uniformity in color, in accordance with surface conditions of the reproduced carpet tiles.

With this method, the used carpet tiles can be cleaned by washing, entangling of piles removed, piles are raised, and may be sheared and reproduced carpet tiles produced. In addition, the surface of the reproduced carpet tile may be treated and is recolored and thus made to look like a new tile.

The retexturing of the present invention means removal of entangling of piles and raising of piles (and may include shearing, vacuuming, and brushing).

According to another aspect of the invention, there is provided a method of reproducing/recoloring carpet tiles, characterized by:

- a recovery step of recovering carpet tiles in use;
- a first choosing step of choosing the recovered carpet tiles according to the condition of use;
- a washing/reproducing step of performing cleaning for cleaning dirt, grit, and/or stain on the chosen carpet tiles, and performing retexturing, thus forming reproduced carpet tiles;
- a second choosing step of choosing the reproduced carpet tiles according to at least one of the degree of stain and the density of color;
- a selection step of selecting such a design or color, or both, as to prevent non-uniformity of stain and color, according to the conditions of surfaces of the chosen reproduced carpet tiles;
- a recoloring step of recoloring the reproduced carpet tiles using a printing, dyeing, or coloring machine, with the selected design or color or both;
- and a third choosing step for choosing the recolored carpet tiles obtained by the recoloring step, on the basis of the degree of uniformity in density of color.

With this method, the carpet tiles in use are recovered and subjected to the first choosing (or elimination) step. Thus, carpet tiles which are difficult to reproduce, refurbish, renew, etc. and recolor can be eliminated or categorized prior to washing. Essentially, this choosing step can be described as sorting out tiles that can not be reused due to physical damage or defects, for example as cuts, holes, torn carpet, separated backing or small pieces cut to match or fit to a room. In addition, by subjecting the washed reproduced carpet tiles to the second choosing step, it becomes easy to select the design or color, or both, according to the damage or stain which could not be discriminated before washing. Moreover, the reproduced carpet tiles which have been treated with the selected design or color or both are subjected to the third choosing step, whereby the category and/or usability/non-usability of each carpet tile can be determined according to the stain, density of color, etc. of the reproduced/recolored carpet tile. The choosing steps can aid in determining which products are sold as firsts, seconds, thirds, or discarded (or destructively recycled).

According to still another aspect of the invention, the method further includes a step of decoloring the reproduced carpet tiles between the washing/reproducing step and the recoloring step.

With this method, the stain or non-uniformity in color remaining after washing can be made less visible.

According to still another aspect of the invention, the method further includes, between the washing/reproducing step and the recoloring step, a step of coating the reproduced carpet tiles with at least one of a chemical agent with a water-repellent effect and a chemical agent with a coloring agent diffusion prevention effect, which enhances clearness of surfaces of the reproduced carpet tiles.

With this method, the treatment with the design or color can be made easier and have better uniformity.

According to still another aspect of the invention, the method further includes a surface treatment step of treating surfaces of the reproduced carpet tiles with at least one of a stainproof agent for preventing the reproduced carpet tiles from being stained, an antistatic agent for suppressing static electricity and a germicidal-effect agent having a germicidal effect. The surface treatment step being carried out prior to, during or following the recoloring step or one of steps following the recoloring step.

With this method, the surfaces of reproduced carpet tiles can be protected against stains, static electricity or propagation of germs.

According to still another aspect of the invention, the method further includes a bending step of bending the curved reproduced carpet tiles to the original shape, prior to or in the washing/reproducing step or any of the steps following the washing/reproducing step.

With this method, the carpet tile curved in the reproducing step can be substantially flattened.

According to still another aspect of the invention, the method further includes a cutting or trimming step of cutting out or trimming off edge portions of the reproduced tiles, where piles have fallen, which are left after completion of the above steps, the cutting step being performed prior to or in the washing/reproducing step or any one of the steps following the washing/reproducing step.

With this method, entangling of piles can be removed, seamability can be improved, design or pattern registration can be improved, and an undesirable external appearance of the carpet tile is improved.

According to another aspect of the invention, the method further includes a shearing, vacuuming and/or brushing step of shearing the top of the pile, vacuuming the pile and/or brushing the pile to create a constant height pile and/or an upright pile preferably prior to the recoloring step and following the washing step.

According to another aspect of the present invention, the method further includes a back coating step of coating the back of the carpet tile with a thin layer of a sealant and/or a cushion layer. It is preferred to back coat following washing/reproducing and recoloring.

According to still another aspect of the present invention, there is provided a method of maximizing the inherent value in used carpet tile by non-destructively recycling used carpet tiles (washing/reproducing, recoloring, etc.). In one embodiment, reproduced/recolored carpet tile are inventoried for sale as reproduced, renewed, refurbished, or recycled carpet tiles. In another embodiment, these renewed, refurbished, recycled carpet tiles are donated to charity, public institutions, schools, etc. In yet another embodiment, renewed, refurbished, or recycled carpet tiles are created from used carpet tiles from a selected company or location and are sold back to or installed back in that same company or location. In still another embodiment, used carpet tiles are washed/reproduced and inventoried, then when an order for reproduced/recolored carpet tiles is made, the inventoried washed/reproduced carpet tiles are recolored and shipped.

In still yet another embodiment, used carpet tiles are inventoried, then when an order for reproduced/recolored carpet tile is made, the inventoried used carpet tiles are washed/reproduced, recolored, and shipped.

In accordance with another aspect of the present invention, there is provided a method of providing or marketing carpet tile by offering new carpet tiles and/or reproduced/recolored carpet tiles. Presumably, reproduced/recolored (recycled) carpet tile would be offered at a lower price than new carpet tile of the same grade and quality. Price blending of the higher priced new carpet tiles and lower priced reproduced/recolored carpet tiles can reduce the total cost of a carpet tile project or sale. The cost of renewed or reproduced carpet is less than that of buying new carpet and land filling the used carpet even if the sale price of renewed carpet is more per square yard or meter than new carpet due to the disposal costs of used carpet.

In accordance with another aspect of the present invention, there is provided a method of providing and marketing extended life, renewable carpet tile where the carpet tile is installed, used, taken up, reproduced/recolored, reinstalled, used, taken up, reproduced/recolored, reinstalled, used, taken up, reproduced/recolored, reinstalled, used, etc. Following two or more generations of use, the carpet tile may be discarded or destructively recycled. For example, new carpet tile may be sold as 15–30 year carpet tile which can be sold new and reproduced/recolored two or more times. Each time the carpet tile is reproduced/recolored, it can be colored, patterned, designed, etc. to give it a new look which is appropriate for that time frame so the reproduced/recolored carpet tile is like new carpet tile of that time period (fresh, new look). Hence, 30 year old carpet tile would not look 10, 20, or 30 years old.

In accordance with another aspect of the invention, there is provided a method or service of collecting used carpet tiles, reproduced/recoloring the collected used carpet tiles, and selling the reproduced/recolored carpet tiles. This would substantially reduce or eliminate the land filling or incineration charges for discarding or disposing of used carpet tiles. Also, although it is not preferred, used carpet tiles can be collected, washed, and sold as washed used carpet tiles or as seconds. Also, a first business can collect used carpet tiles, a second business wash the collected used carpet tiles, and a third business reproduce/recolor the washed carpet tiles, etc.

According to still another aspect of the invention, there is provided a method of recycling carpet tiles in a plurality of division areas, in each of which a plurality of carpet tiles are laid, the method including the steps of: removing carpet tiles in a first division area, which are to be first reproduced; laying auxiliary carpet tiles on the first division area from which the carpet tiles have been removed; reproducing the removed carpet tiles; removing carpet tiles in a second division area, which are to be subsequently reproduced; and successively laying the first removed and reproduced carpet tiles on the second division area from which the carpet titles were removed; and the like.

With this method, auxiliary or reproduced carpet tiles are laid on a division area from which carpet tiles have been removed. Removed and reproduced carpet tiles from a selected division can be laid back on that same division area if they provide time to remove, wash/reproduce, recolor, and install.

BRIEF DESCRIPTION OF THE SEVERAL VIEWS OF THE DRAWING

FIG. 4 is a top view of another specific example of an embodiment in which the continuity of a pattern is cut off;

FIG. 5 is a top view of still another specific example of an embodiment in which the continuity of a pattern is cut off;

FIG. 6 is a top view of still yet another specific example of an embodiment in which the continuity of a pattern is cut off;

DETAILED DESCRIPTION OF THE INVENTION

Exemplary methods and products made thereby according to aspects or embodiments of the present invention will now be described with reference to the accompanying drawings.

Figure 1:
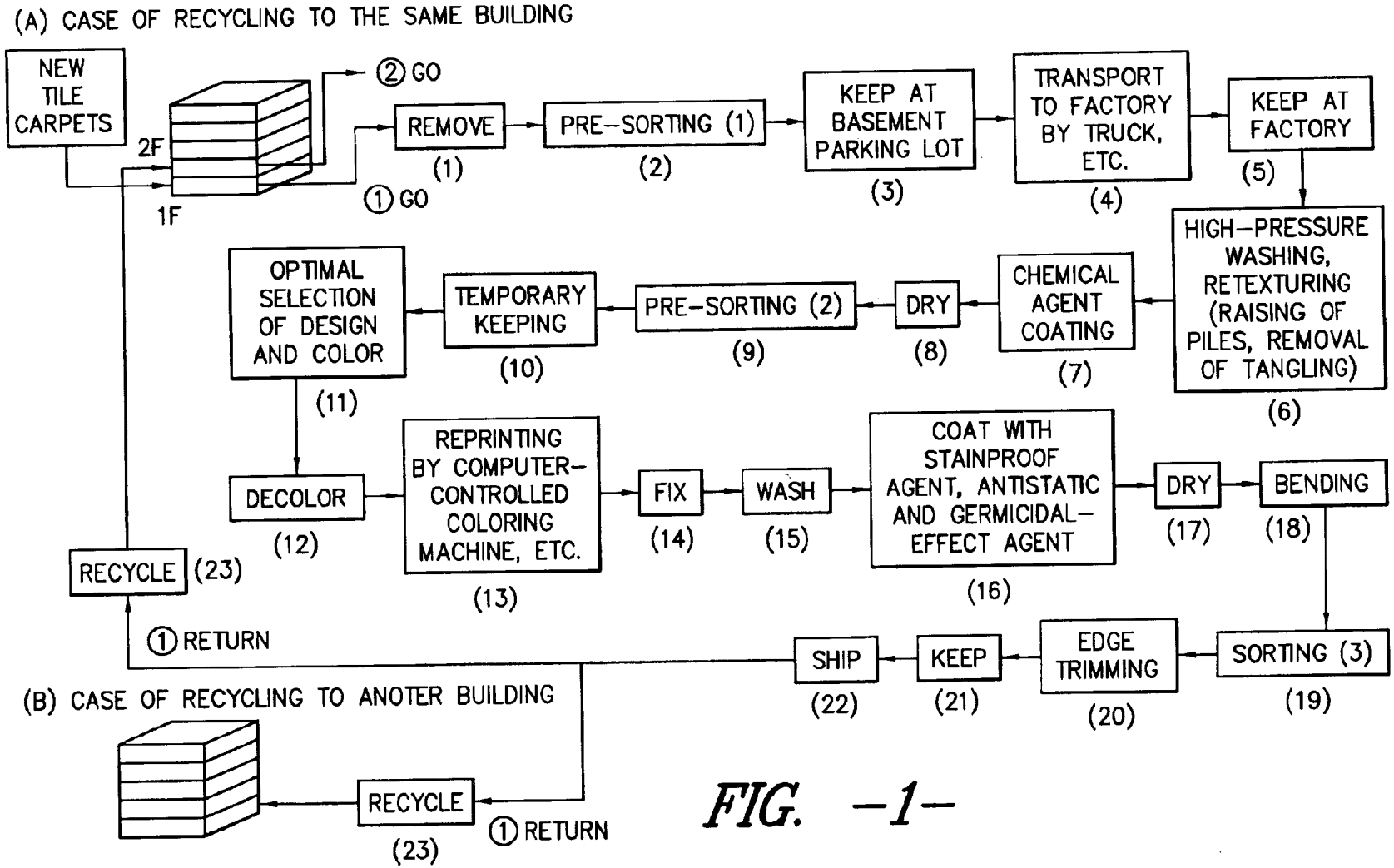
FIG. 1 is a block diagram illustrating an exemplary process of reproducing/recoloring carpet tiles.

FIG. 1 is a block chart or diagram illustrating steps of an exemplary renewal, refurbishment, or reproducing/recoloring method. Such a method may also be referred to as a non-destructive recycling method. The steps will now be described with reference to FIG. 1.

(1) At the site for flooring, for instance, in a building, carpet titles in use are successively removed from the floor (indicated by (1) Go and (2) Go in FIG. 1), for example, in units of a group of carpet titles laid on each floor, while avoiding as much as possible damage to the carpet tiles.

(2) The removed carpet tiles are sorted (pre-sorted) into reproducible ones and non-reproducible ones, according to, e.g. the presence/absence of great damage, considerable stain, and conspicuous fallen piles. Essentially, this choosing step can be described as sorting out tiles that can not be reused due to physical damage or defects, for example, as cuts, holes, torn carpet, separated backing or small pieces cut to match or fit to a room. Even non-skilled persons can sort the carpet tiles by using, for instance, samples indicating limits. The carpet tiles, which have been determined to be non-reproducible, are discarded or destructively recycled.

(3) The carpet tiles, which have been determined to be reproducible, are kept, for example, in an empty space, such as a basement parking lot, in the building in which the carpet tiles are being exchanged, until the number of such carpet tiles reaches a predetermined value (e.g. the number corresponding to a maximum load of a truck for transportation).

(4) The predetermined number of carpet tiles are brought to a renewal or reproduction factory by a transportation means such as a truck.

(5) The carpet tiles brought to the reproduction factory are preferably kept in a dry place or a place with low humidity and, immediately thereafter, subjected to a washing process. Also, the carpet tiles may be steam pre-bulked prior to washing using a steam chamber to steam and pre-bulk the yarn (pile).

Figure 2:
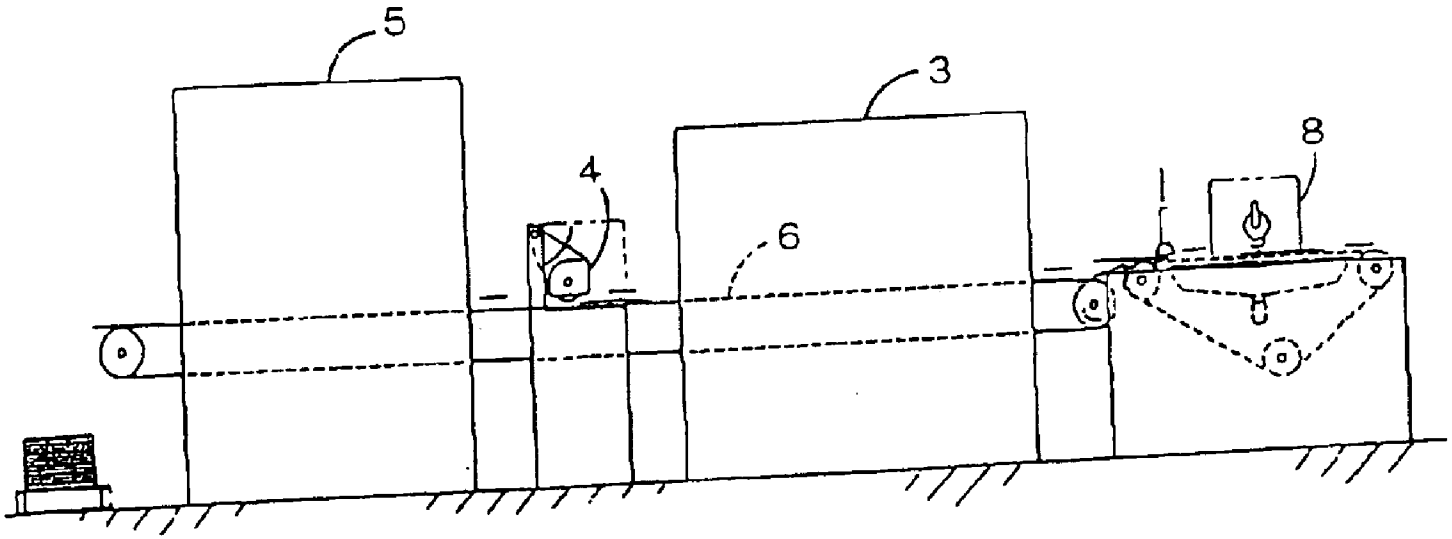
FIG. 2 is a schematic side view of a structure of a carpet tile reproducing apparatus.

(6) In the washing process, preferably a high-pressure washing apparatus denoted by numeral 8 in FIG. 2 (e.g. an apparatus disclosed, for example, in Jpn. Pat. Appln. KOKAI Publication No. 6198265 or U.S. Pat. Nos. 5,381,592 and 5,457,845 hereby incorporated by reference herein or a spray nozzle type high pressure washing device) is used. In the high-pressure washing apparatus 8, a pressurized washing liquid (which may also be heated) is jetted on the carpet tiles which are passed underneath while being conveyed over a conveyor 6. Thus, the carpet tiles are cleaned. With such cleaning, dirt, dust, mud, sand, and part of stain on the carpet tile is eliminated. In addition, a retexturing process for removing entangling of weaving yarns (piles) and raising them is performed. The high-pressure washing apparatus has a dryer or drying machine 3 for drying the cleaned carpet tiles, a cutting or shearing machine 4 (not always required) for making the height of piles uniform, a printing, dyeing or coloring machine 5 for coloring carpet tiles, and the conveyor 6 for successively conveying the carpet tiles.

In accordance with one embodiment of the present invention, universal spray nozzles are used to project a washing fluid such as high pressure water at the pile side of the used carpet. The high pressure water may be at a pressure of about 100–3,000, preferably 200–2,000 pounds per square inch (psi) and at a flow rate of about 30–200, preferably 30–65 gallons per minute (gpm), with the spray nozzles moved or indexed across the face of the used carpet or with the used carpet moved or indexed under one or more spray nozzles. Also, a germicidal, anti-microbial, anti-fungal, and/or anti-bacterial agent or agents can be added to the washing liquid.

(7) In order to enhance the clearness of the reproduced carpet tiles which are to be subjected to a recoloring process in a subsequent step (13), the washed/reproduced carpet tiles are subjected to a coating or applying process wherein the carpet tiles are coated or treated with a cationic, water soluble, polymeric chemical agent or compound or a chemical agent for preventing blurring of a coloring agent. This coating process is performed, for example, using chemical agents to enhance dyeing or coloring and such properties as to prevent diffusion of coloring agent. The chemical agents facilitate uniform dyeing and pattern clarity by controlling the rate of dye uptake on the pile yarns.

(8) Following the coating process, the carpet tiles are dried.

(9) There is a wide range of variation in the degree of stain and falling of piles among the carpet tiles in use. After the high-pressure cleaning, the range of such variation decreases, but some variation remains. In order to solve this problem, the dried carpet tiles are sorted using samples indicating limits, like the above mentioned sorting step (2), prior to recoloring or reprinting.

(10) The sorted carpet tiles, which are suitable for reprinting, are kept. The carpet tiles, which are unsuitable, are returned to one of the preceding steps or are discarded (or destructively recycled).

(11) Using a computer, etc., such a design and/or color as to make a stain less remarkable is selected. The design and/or color selection provide a way to minimize differences in appearance between individual tiles. Some examples of this selection will be described in connection with a subsequent step (13).

(12) The washed carpet tiles are decolored on an as-needed basis. By this decoloring step, the stain, color and pattern on the reproduced carpet tile can be made faint. In general, as carpet tiles are reproduced repeatedly, the color thereof becomes denser. When the color has become denser than desired or when the color needs to be made faint, the decoloring step is effective. This process is performed by using a chemical agent having a decoloring function.

Figure 3:
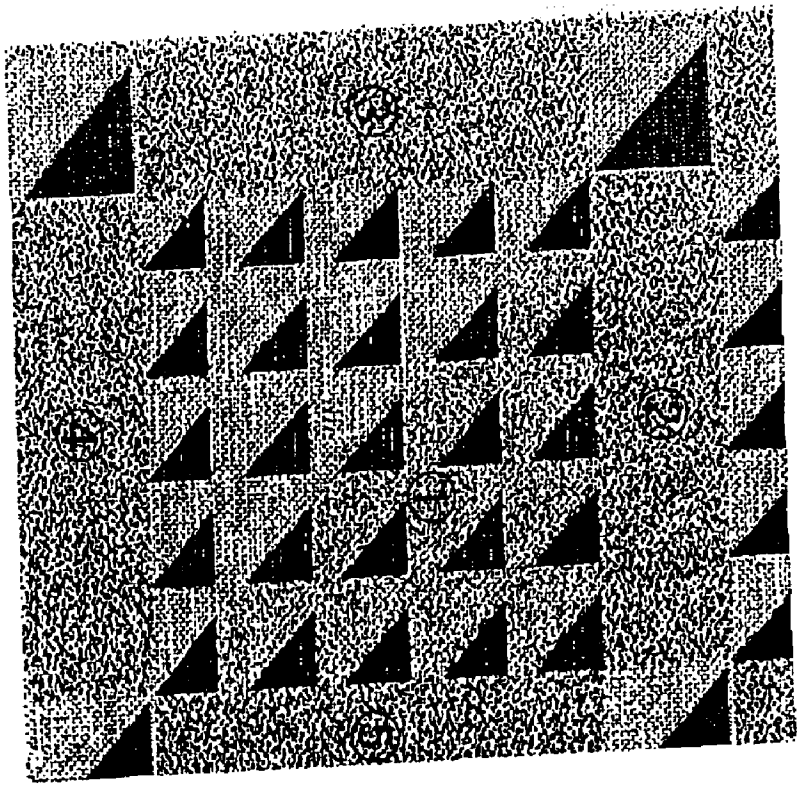
FIG. 3 is a top view of a specific example of an embodiment in which the continuity of a pattern is cut off.
Figure 7:
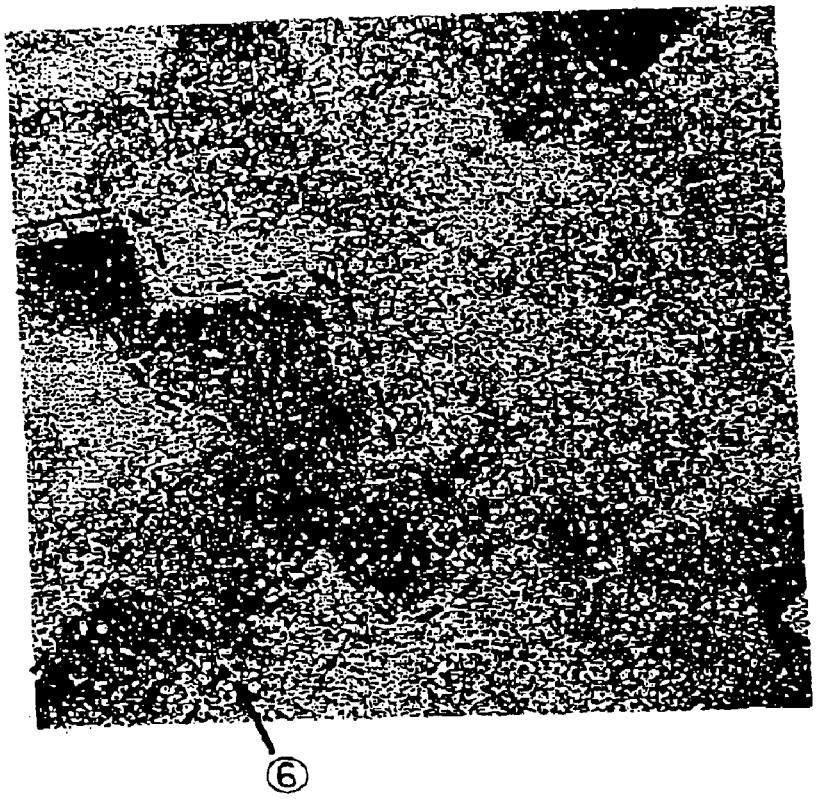
FIG. 7 is a top view of a specific example of an embodiment in which a stained pattern on a carpet tile is utilized.
Figure 8:
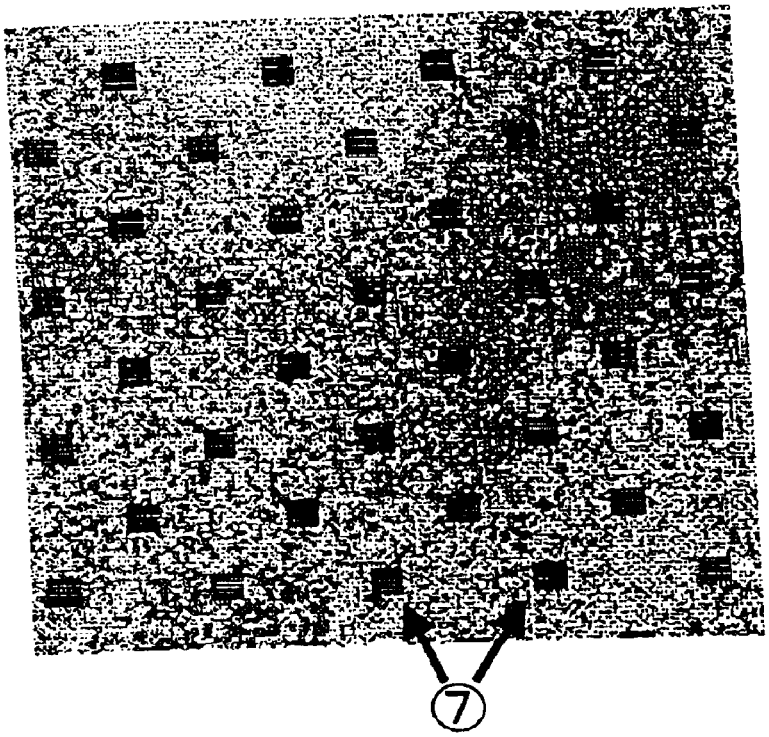
FIG. 8 is a top view of a specific example of an embodiment in which a carpet tile is provided with an accent effect.
Figure 9:
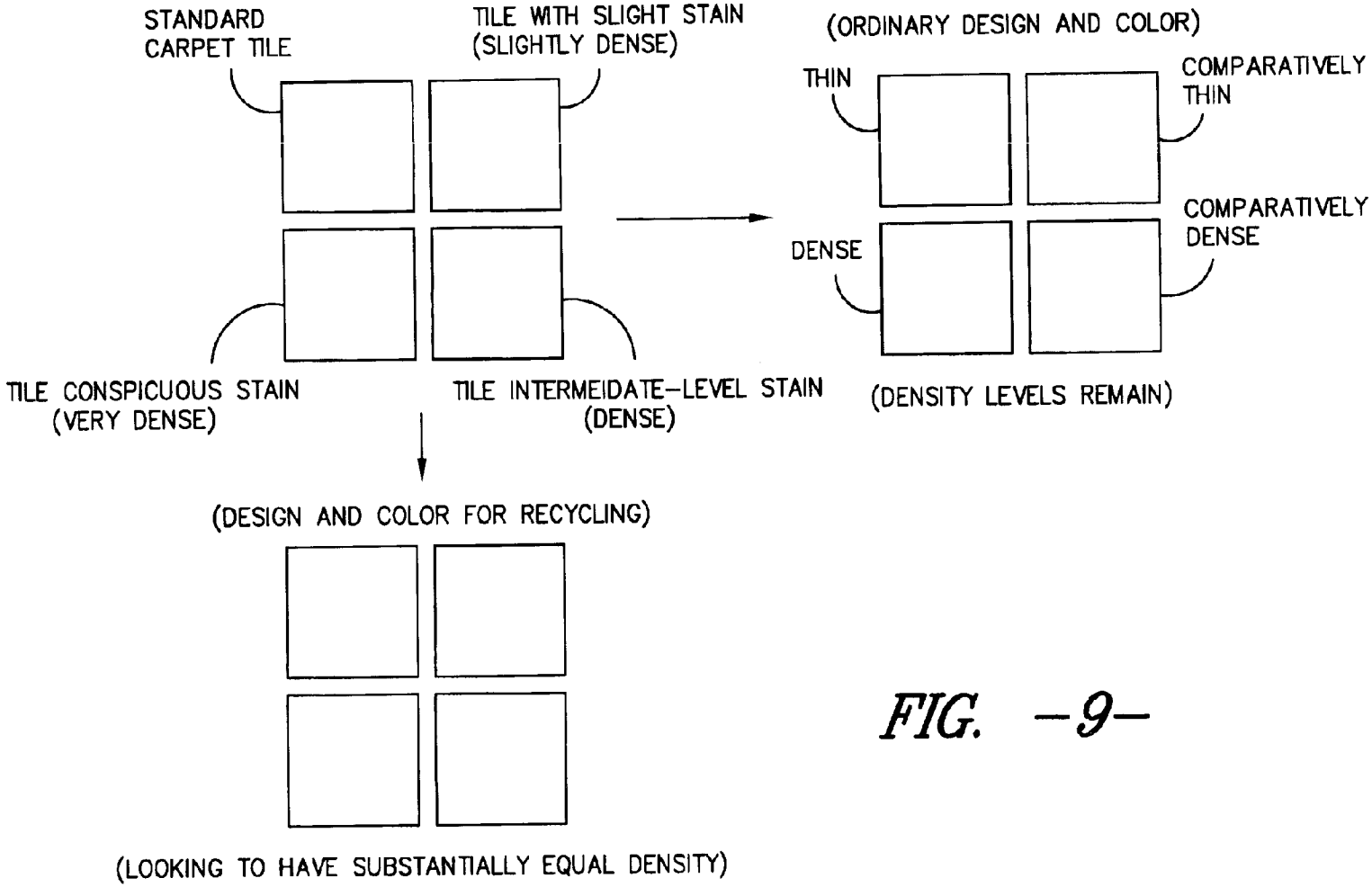
FIG. 9 is a diagram of an example of comparison between an ordinary design and color and a design and color for recycling according to one embodiment of the invention.

(13) Whether the reproduced carpet tiles can be recycled or not depends greatly on, e.g. how reprinting is performed by using a computer-controlled printing, dyeing, or coloring machine. In the computer control, for example, image information prepared by a design computer is digitized, this information is delivered to the coloring machine 5 shown in FIG. 2, and the coloring machine 5 is operated. A first problem to be solved in connection with the reproduced carpet tile is the occurrence of non-uniformity of color in the re-printing process using the tile coloring machine. This is due to the fact that, as described in connection with step (9), there is a wide range of variation in the degree of stain and falling of piles among the carpet tiles in use, depending on, for instance, the location of use, the condition of use and the length of time of use. In order to solve this problem, a first-stage uniformization is carried out by cleaning and retexturing effect. A secondstage unformization is carried out by selecting an optimal design and color (design and color for reproduction/recycling) according to the surface condition of the reproduced carpet tiles. For example, there are four methods (a) to (d), as described below, for selecting the design and color. FIG. 3 shows an embodiment ("cut off effect") showing a part of a reproduced carpet tile, the design and color of which have been selected. FIG. 4 is a schematic view of an embodiment wherein a cut off effect is obtained by arranging four different patterns X, Y, Z and W of reproduced carpet tiles adjacent to one another. Thus, the four patterns are discontinued, and the cut off effect is obtained. FIG. 5 shows an embodiment wherein reproduced carpet tiles having the same pattern are arranged adjacent to one another, with their angles turned 90° relative to one another. Thereby, the cut off effect is obtained. FIG. 6 shows an embodiment wherein reproduced carpet tiles with large and small patterns are alternately arranged and thus the cut off effect is obtained. FIG. 7 shows an embodiment of a part of a reproduced carpet tile leaving a "random effect" by which random stain or non-uniform color on the reproduced carpet tile is made less visible. FIG. 8 shows an embodiment of a part of a reproduced carpet tile having an "accent effect" by which a design is provided with accents and a stain or non-uniform color on the reproduced carpet tile is made less visible. FIG. 9 is a schematic view comparing an ordinary design and color of a reproduced carpet tile and a design or color for reproduction/recycling according to an equal density embodiment.

(a) As is shown in FIG. 3, triangular accents (conspicuous dense color) indicated by (1) are provided on the surface of, e.g. a square carpet tile. The continuity of the areas (2)–(5) is cut off by the pattern (1). Thereby, any stain or non-uniformity in color is made less visible. Alternatively, as shown in FIG. 4, a combinational pattern composed of, e.g. four carpet tiles X, Y, Z and W is used. For example, the continuity of patterns of carpet tiles X and Z is cut off by the pattern of carpet tiles Y and W. Thereby, the stain or non-uniformity in color is made similarly less visible. Other specific examples or embodiments are shown in FIGS. 5 and 6. The continuity of adjacent patterns is cut off and any stain or non-uniformity in color is made less visible.

(b) As is shown in FIG. 7, for example, a random design as indicated by a broken line (6) is adopted. Thereby, stain or non-uniformity in color is made indistinguishable from a new design ("random effect") and the stain or non-uniformity in color is made less visible.

(c) As is shown in FIG. 8, for example, a dot pattern with an accenct effect, as indicated by (7) is disposed so that any stain or non-uniformity in color is made less visible.

(d) Where a stain or non-uniform color remains even after cleaning, such a stain or color may be intentionally used as a design. Thereby the stain or color gives such an impression that it were a real design, and the stain or non-uniform color can be made less visible.

A second problem to be solved in connection with the reproduced carpet tile is the tendency that the color of the carpet tile becomes denser as the reprinting is repeated. This is due to the fact that a dense color is designed or printed on a faint previous color, thereby to obtain a clearer pattern. As has been described in connection with step (12), this problem can be solved by using a chemical agent having a decoloring effect. Specifically, a chemical agent having a decoloring effect is coated prior to or at the time of re-printing. Thereby, the color can be made thinner or, after the original color is completely lost, a different color can be printed. As a result, the density of color can be varied to meet the need.

Specifically, as is shown in FIG. 9, in the case of the ordinary design and color, a high density of color tends to remain as such, as the density of color before the printing of the reproduced carpet tile is higher (the degree of stain and non-uniformity in color is great). By choosing the proper design and color for reproduction/recycling, the density of color can be made substantially uniform.

(14)–(17) After re-printing, the dye or color is fixed on the carpet tile and the carpet tile is washed, a surface treatment process is performed to coat the carpet tile with a stainproof agent for preventing the carpet tile from being stained, an antistatic agent for suppressing static electricity, and/or a germicidal-effect agent having a germicidal effect, then, the carpet tile is dried.

(18) A third problem to be solved in connection with the reproduced carpet tile is that the carpet tile in use may be curled in the reproducing step. In order to solve this problem, the carpet tile is forcibly bent in the opposite direction by means of, e.g. a bending machine.

(19) Where there remains a problem which has not been solved by the first-stage and second-stage uniformization or the countermeasure (13) to the first problem, third-stage uniformization is carried out by performing final choosing based on the density of color. Carpet tiles, which have been determined to be unacceptable by the final choosing, are discarded (or destructively recycled).

(20) A fourth problem to be solved in connection with the reproduced carpet tile is that piles on the edge portion of the tile have fallen due to the high pressure washing. In order to solve this problem, fallen piles, which are conspicuous, are cut or trimmed by a machine such as an edge trimmer or shear. Also, the face pile may be sheared to give the tile a better appearance or to make the pile height uniform.

(21)(22) The reproduced carpet tiles are temporarily kept and then shipped.

(23) Where the reproduced/recolored carpet tiles are recycled, some methods can be adopted, one of such methods is illustrated in FIG. 1 (A), wherein the reproduced carpet tiles are recycled to the same building. For example, used carpet tiles on the first floor are removed, and new or auxiliary carpet tiles are laid on the first floor, while the carpet tiles removed from the first floor are reproduced by the reproducing process. The used carpet tiles from the second floor are removed. The reproduced carpet tiles from the first floor are laid on the second floor. In this case, the carpet tiles removed from the second floor, which would normally be discarded, are reproduced by the reproducing process. In this manner, carpet tiles on all floors of the building can be removed, reproduced and replaced successively in units of a floor or a division area. The used carpet tiles from the top floor are either discarded or reproduced and used in another building, donated to charity, saved, or stored as replacement carpet tiles for the second-top floors of the same building.

Another method is illustrated in FIG. 1 (B), wherein the reproduced carpet tiles are recycled to another building. This method is effective, for example, in franchised shops or in branches of a large-scale company. By this method, the effect on the business activities and customer services can be limited to a minimum (e.g. the time period of non-operating time can be reduced).

Some of the steps of the above-described methods can be omitted or the order of steps can be changed according to the degree of damage, stain and falling of piles on the used carpet tiles.

Figure 10:
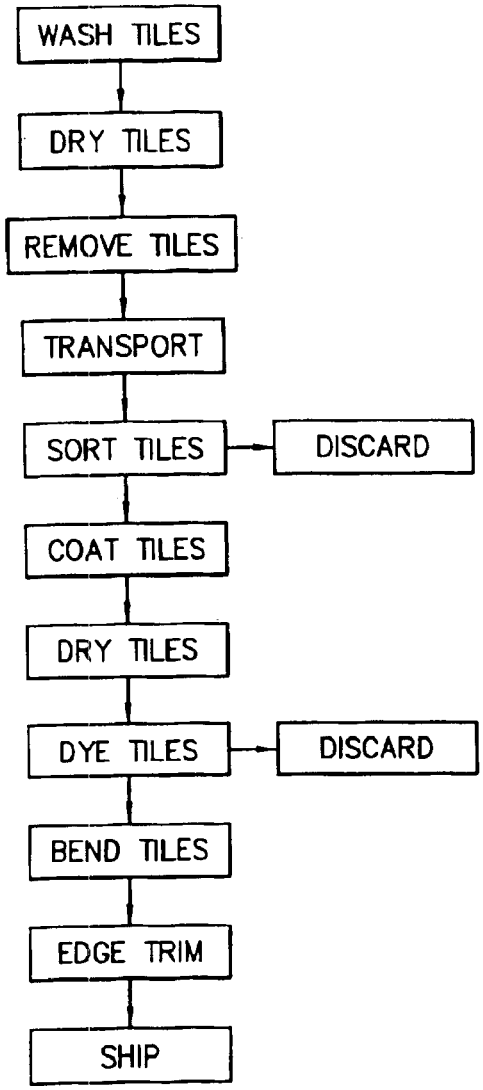
FIG. 10 is a block diagram representing another exemplary process of the present invention.

FIG. 10 is a block chart or diagram illustrating the steps of an alternative renewal or reproducing method. The steps will now be described with reference to FIG. 10.

(1) At the site for flooring, for instance, in a building, carpet tiles in use are washed or cleaned, dried, and then successively removed from the floor, for example, in units of a group of carpet titles laid on each floor, while avoiding as much as possible damage to the carpet tiles.

(2) The washed, dried, and removed carpet tiles are brought to a renewal or reproduction factory by a transportation means such as a truck.

(3) The removed and/or transported carpet tiles are sorted into renewable or reproducible ones and non-reproducible ones, according to, e.g. the presence/absence of great damage, considerable stain, and conspicuous fallen piles. Even non-skilled persons can sort the carpet tiles by using, for instance, samples indicating limits. The carpet tiles, which have been determined to be non-reproducible, are washed again and/or discarded.

(4) The carpet tiles brought to the reproduction factory may be kept at a place with low humidity and, immediately thereafter, subjected to a coating process. Low humidity storage of used carpet tiles is not required for temporary storage thereof.

(5) In order to enhance the clearness of the reproduced carpet tiles which are to be subjected to a recoloring or patterning process in a subsequent step (11), the reproduced carpet tiles are subjected to a coating or applying process wherein the carpet tiles are coated or treated with a chemical or compound to enhance dyeing or coloring and/or for preventing blurring of a coloring agent. This coating process is performed, for example, using cationic, water soluble, polymeric chemical agents having water-repellent properties and such properties as to prevent diffusion of coloring agent.

(6) Following the coating process, the carpet tiles are dried.

(7) There is a wide range of variation in the degree of stain and falling of piles among the carpet tiles in use. After the high-pressure cleaning, the range of such variation decreases, but some variation remains. In order to solve this problem, the dried carpet tiles may be sorted using samples indicating limits, like the above mentioned sorting step (3), prior to recoloring or reprinting.

(8) The sorted carpet tiles, which are suitable for reprinting, are kept. The carpet tiles, which are unsuitable, are returned to one of the preceding steps or are discarded.

(9) Using a computer, etc., such a design or color as to make a stain less remarkable is selected. Some examples of this selection will be described in connection with a subsequent step (11).

(10) The washed carpet tiles are decolored on an as-needed basis. By this decoloring step, the stain, color and pattern on the reproduced carpet tile can be made faint. In general, as carpet tiles are reproduced repeatedly, the color thereof becomes denser. When the color has become denser than desired or when the color needs to be made faint, the decoloring step is effective. This process is performed by using a chemical agent having a decoloring function.

(11) Whether the reproduced carpet tiles can be recycled or not depends greatly on, e.g. how reprinting is performed by using a computer-controlled coloring machine. In the computer control, for example, image information prepared by a design computer is digitized, this information is delivered to the coloring machine 5 shown in FIG. 2, and the coloring machine 5 is operated. A first problem to be solved in connection with the reproduced carpet tile is the occurrence of non-uniformity of color in the re-printing process using the coloring machine. This is due to the fact that, as described in connection with step (7), there is a wide range of variation in the degree of stain and falling of piles among the carpet tiles in use, depending on, for instance, the location of use, the condition of use and the length of time of use. In order to solve this problem, a first-stage uniformization is carried out by cleaning and retexturing effect. A secondstage unformization is carried out by selecting an optimal design and color (design and color for reproduction/recycling) according to the surface condition of the reproduced carpet tiles. For example, there are four methods (a) to (d), as described below, for selecting the design and color. FIG. 3 shows an embodiment ("cut off effect") showing a part of a reproduced carpet tile, the design and color of which have been selected. FIG. 4 is a schematic view of an embodiment wherein a cut off effect is obtained by arranging four different patterns X, Y, Z and W of reproduced carpet tiles adjacent to one another. Thus, the four patterns are discontinued, and the cut off effect is obtained. FIG. 5 shows an embodiment wherein reproduced carpet tiles having the same pattern are arranged adjacent to one another, with their angles turned 90° relative to one another. Thereby, the cut off effect is obtained. FIG. 6 shows an embodiment wherein reproduced carpet tiles with large and small patterns are alternately arranged and thus the cut off effect is obtained. FIG. 7 shows an embodiment of a part of a reproduced carpet tile leaving a "random effect" by which random stain or non-uniform color on the reproduced carpet tile is made less visible. FIG. 8 shows an embodiment of a part of a reproduced carpet tile having an "accent effect" by which a design is provided with accents and a stain or non-uniform color on the reproduced carpet tile is made less visible. FIG. 9 is a schematic view comparing an ordinary design and color of a reproduced carpet tile and a design or color for reproduction/recycling according to an embodiment.

A second problem to be solved in connection with the reproduced carpet tile is the tendency that the color of the carpet tile becomes denser as the reprinting is repeated. This is due to the fact that a dense color is designed or printed on a faint previous color, thereby to obtain a clearer pattern. As has been described in connection with step (12), this problem can be solved by using a chemical agent having a decoloring effect. Specifically, a chemical agent having a decoloring effect is coated prior to or at the time of re-printing. Thereby, the color can be made thinner or, after the original color is completely lost, a different color can be printed. As a result, the density of color can be varied to meet the need.

Specifically, as is shown in FIG. 9, in the case of the ordinary design and color, a high density of color tends to remain as such, as the density of color before the printing of the reproduced carpet tile is higher (the degree of stain and non-uniformity in color is great). If the design and color for reproduction/recycling, the density of color can be made substantially uniform.

(12)–(15) After re-printing is fixed on the carpet tile and the carpet tile is washed, a surface treatment process may be performed to coat the carpet tile with a stainproof agent for preventing the carpet tile from being stained, an antistatic agent for suppressing static electricity, and a germicidal-effect agent having a germicidal effect, then, the carpet tile is dried.

(16) A third problem to be solved in connection with the reproduced carpet tile is that the carpet tile in use may be curled in the reproducing step. In order to solve this problem, the carpet tile is forcibly bent to the opposite direction by means of, e.g. a bending machine.

(17) Where there remains a problem which has not been solved by the first-stage and second-stage uniformization of the countermeasure (11) to the first problem, third-stage uniformization is carried out by performing final choosing based on the density of color. Carpet tiles, which have been determined to be unacceptable by the final choosing, are discarded.

(18) A fourth problem to be solved in connection with the reproduced carpet tile is that piles on the edge portion of the tile have fallen. In order to solve this problem, fallen piles, which are conspicuous, are cut by a machine such as an edge trimmer or shear.

(19)(20) The reproduced carpet tiles may be temporarily kept and then shipped.

(21) Where the reproduced carpet tiles are recycled, some methods can be adopted, one of such methods is wherein the reproduced carpet tiles are recycled to the same building. For example, new carpet tiles are laid on the first floor, while the carpet riles in use on the first floor are removed and reproduced by the reproducing process. The reproduced carpet tiles are laid on the second floor. In this case, the carpet tiles in use on the second floor, which should normally be discarded, are brought to the reproducing process. In this manner, carpet tiles on all floors of the building can be reproduced and replaced successively in units of a floor or a division area. The used carpet tiles from the top floor are either discarded or reproduced and used in another building, donated to charity, or saved or stored as replacement carpet tiles for the second-top floors of the same building. Another method is wherein the reproduced carpet tiles are recycled to another building. This method is effective, for example, in franchised shops or in branches of a large-scale company. By this method, the effect on the business activities and customer services can be limited to a minimum (e.g. the time period of non-operating time can be reduced).

Some of the steps of the above-described methods can be omitted or the order of steps can be changed according to the degree of damage, stain and falling of piles on the used carpet tiles.

Figure 11:
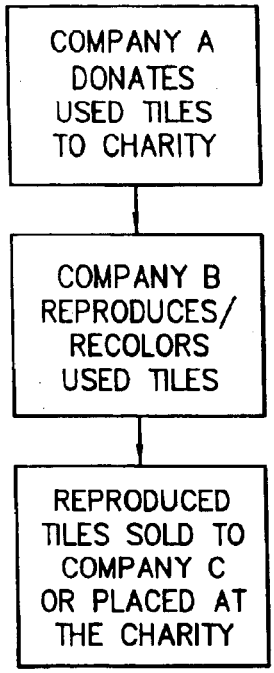
FIG. 11 is a block diagram illustrating still another exemplary process.

As shown in FIG. 11 and in accordance with another embodiment, the used carpet tiles of a business, office, floor, or building are donated to charity. These donated carpet tiles are reproduced and either sold by the charity or installed at the charity or a location selected by charity.

Figure 12:
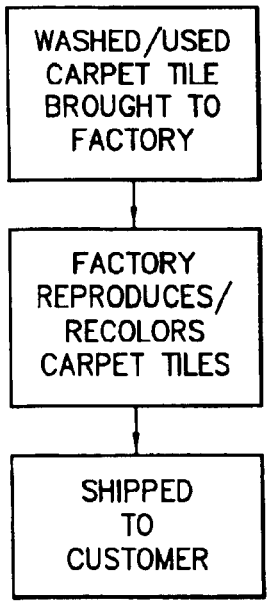
FIG. 12 is a block diagram representing yet another process embodiment.

As shown in FIG. 12 and in accordance with another embodiment, washed used carpet tile are brought to the reproducing factory and treated by steps (7)–(12) of FIG. 1 and then either picked up by the customer or shipped to the customer.

Figure 13:
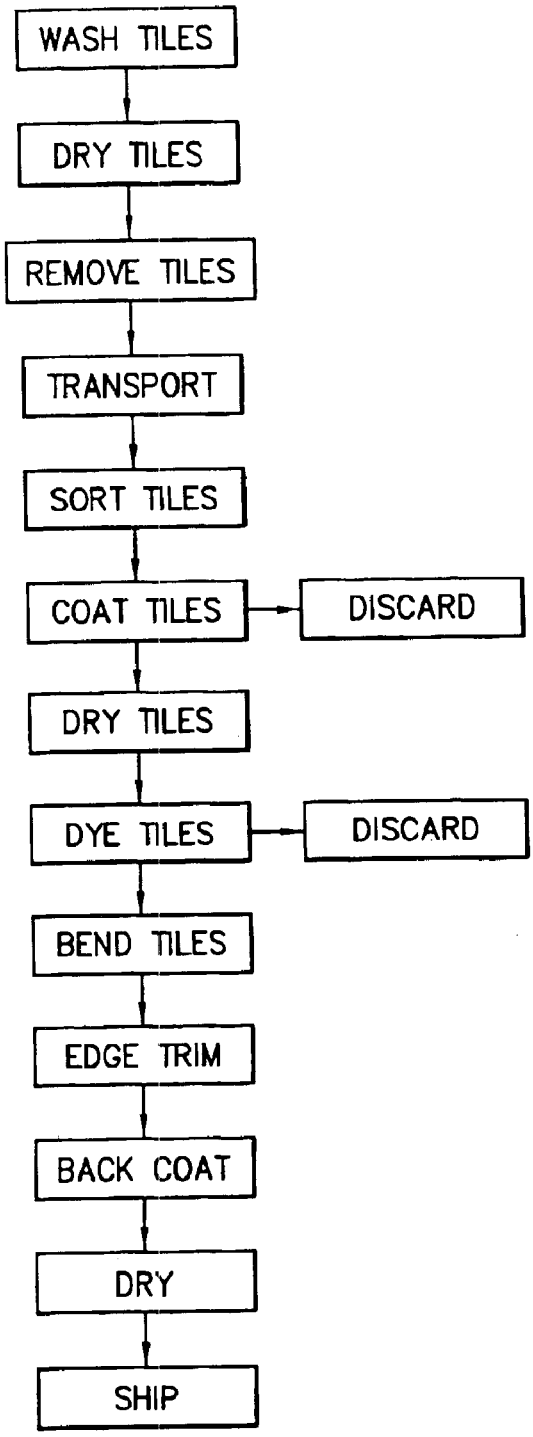
FIG. 13 is a block diagram illustrating still another process embodiment; and, FIG. 14 is a block diagram of yet still another process embodiment.

As shown in FIG. 13 the reproducing process may also include a back coating step and drying step wherein the back surface of the carpet tile is coated or covered with a thin layer of a, for example, coating material to, for example, give the back of the tile a new tile look and smooth appearance. This back coating can be done prior to or following recoloring.

Another problem to be solved with used carpet tile may be related to adhesive residue that may stick to the original backing during removal in the many cases where adhesives were used in the original installation. Back coating or removal of the adhesive residue may be necessary for proper and smooth processing during the patterning step. The backcoating step of the present invention may be used to solve this problem while at the same time giving the tile a "new" appearance.

In accordance with one embodiment of the present invention, the pile face yarns of used carpet tile, or other flooring, is cleaned and re-textured using the above described methods and apparatus. After drying in a conventional oven, a thin layer of approximately 2 mm of modified acrylic material is applied to the back surface of the refurbished carpet tile using roll applicators, thereby creating a new appearance, a new coated product, and refurbishing the back of the used tile.

The tile is subsequently dried in an oven to remove water and cross-link the acrylic polymer. The acrylic-coating layer when cross-linked, bonds to the original tile back and is highly resistant to chemical plasticizers commonly used for PVC backed carpet tile. The new backing layer forms a protective or blocking layer against plasticizer migration, thereby providing unique product attributes for refurbished carpet tile. Tiles may be re-colored using a textile dyeing or pattern process without adversely effecting the renewed tile back.

In accordance with another embodiment of the present invention, the used carpet tile is steamed and the face yarns pre-bulked prior to using the above mentioned methods and apparatus to clean and re-texture the yarns. After washing, the re-textured yarns are chemically treated by applying a cationic, water soluble, polymeric organic compound and dried in an oven to uniform moisture content. After drying, the surface pile yarn is sheared to a uniform and level height, and the tile edges are trimmed or sheared to make the tile square. A pattern jet dye machine is used to apply new dye colors or pattern. The tile is next steamed, washed and dried using conventional methods. Thereafter, the back of the title may be coated as described above.

Figure 14:
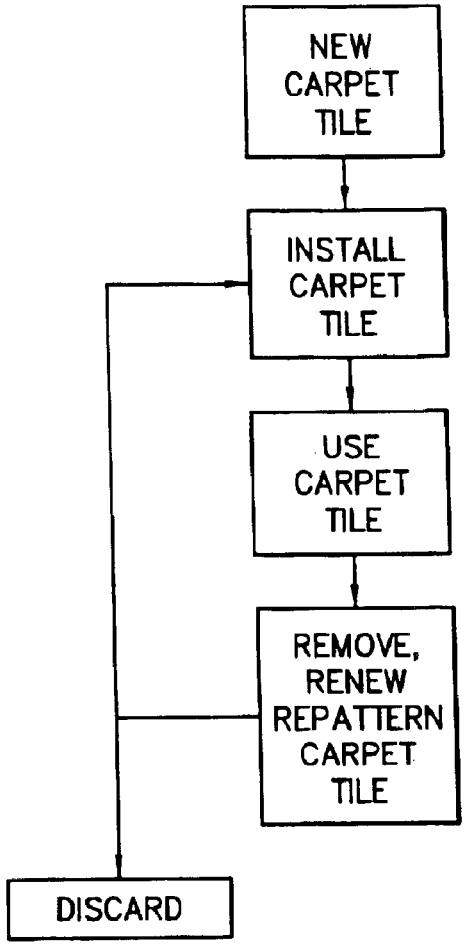

As shown in FIG. 14 and in accordance with another embodiment of the present invention, there is provided a multi-year, multi-cycle renewable flooring system, wherein carpet is laid down first as new carpet tiles, used for a time, then removed, renewed (cleaned, treated, patterned), reinstalled, used for another time or cycle, removed, renewed (cleaned, treated, patterned), reinstalled, used for yet another time or cycle, removed, renewed (cleaned, treated, patterned), reinstalled, and used for still yet another time or cycle, For example, one could sell renewable carpet tile as 30 year or three generation flooring (first generation-new, second generation-renewed, third generation-renewed again) with each generation being, for example, 5–10 years. After the third generation, the carpet can be renewed again or disposed of or destructively recycled.

Due to the high cost of disposing of or destructively recycling (grinding and treating) carpet by conventional means, the present invention provides for the marketing and sale of carpet as renewable carpet which can be renewed and reused instead of disposed of in a landfill or destructively recycled by another move expensive process. The present invention provides for the saving of the existing value in used carpet (fiber, such as nylon, and backing), rather than destructive recycling or land filling of the used carpet.

Also, in accordance with another aspect of the present invention, there is provided a price blended lower cost carpet replacement system. For example, if about 75% of the used carpet tile at a location can be removed, renewed (cleaned, treated, patterned), and reinstalled back at the location, and the price of renewed carpet is less than that of new carpet, then the replacement cost of the carpet of the location can be price blended and reduced by replacing about 25% of the carpet with new carpet and about 75% (the reminder) with renewed carpet. It is difficult to renew 100% of the used carpet because some of the used carpet is badly damaged, stained, cut, or pieces of carpet tile rather than whole carpet tile. It is preferred to renew complete or whole carpet tiles in order to simplify and facilitate the patterning or dyeing process.

In accordance with another aspect of the present invention, cost can be reduced by cutting a larger carpet tile having a bad area that cannot be renewed effectively into halves or quarters using a very accurate cutter apparatus, such as a mint cutter machine having an accuracy of up to about 1/1000 of an inch or better. For example, a 36"×36" carpet tile can be cut into four 18"×18" carpet tiles. If the bad spot is only on one of the 18" carpet tiles or quarters of the original 36" carpet tile, then ¾ of the original carpet tile can be renewed, sold, installed, etc.

Also, for installations that require smaller carpet tiles, such as back office installations, one can cut a 36"×36" tile into 18" tiles, a 1 m×1 m tile into 50 cm×50 tiles, a 40"×40" tile into 20"×20" tiles, etc. Using a very accurate cutter, such as a mint cutter allows for the proper registration of patterns, images, designs, etc. on each of the quarter tiles (cut tiles). Although square tiles are typical in the industry, other shapes such as octagonal, rectangular, circular, or the like may be cut into smaller tiles.

With reference to FIG. 1 of the drawings, an exemplary process is as follows:

(A) CASE OF RECYCLING TO THE SAME BUILDING (B) CASE OF RECYCLING TO ANOTER BUILDING (NEW TILE CARPETS)→[1] (REMOVE)→[2] (PRE-SORTING (1))→[3] (KEEP AT BASEMENT PARKING LOT)→[4] (TRANSPORT TO FACTORY BY TRACK, ETC.)→[5] (KEEP AT FACTORY)→[6] (HIGH-PRESSURE WASHING, RETEXTURING, RAISING OF PILES, REMOVAL OF TANGLING)→[7] (CHEMICAL AGENT COATING)→[8] (DRY)→[9] (PRE-SORTING (2))→[10] (TEMPORARY KEEPING)→[11] (OPTIMAL SELECTION OF DESIGN AND COLOR)→[12] (DECOLOR)→[13] (REPRINTING BY COMPUTER-CONTROLLED COLORING MACHINE, ETC.)→[14] (FIX)→[15] (WASH)→[16] (COAT WITH STAINPROOF AGENT, ANTISTATIC AGENT AND GERMICIDAL-EFFECT AGENT)→[17] (DRY) →[18] (BENDING)→[19] (SORTING (3))→[20] (EDGE (CUTTING) TRIMMING)→[21] (KEEP)→[22] (SHIP)→[23] (RECYCLE)

With reference to FIG. 4, there is shown a repeating pattern of one set of four carpet tiles.

The embodiments of the present invention have been described above with reference to the accompanying drawings. This invention, however, is not limited to such embodiments, and various embodiments and modifications can be made without departing from the spirit of the invention.

What we claim is:

1. A method of recycling carpet tiles in a plurality of division areas, in each of which a plurality of carpet tiles are laid, the method comprising the steps of:

removing carpet tiles in a first division area, which are to be first reproduced;

laying auxiliary carpet tiles on the first division area from which the carpet tiles have been removed;

reproducing the removed carpet tiles;

removing carpet tiles in a second division area, which are to be subsequently reproduced; and successively laying the first removed and reproduced carpet tiles on the second division area from which the carpet tiles were subsequently removed.

2. The method of claim 1, wherein said reproducing step includes:

a washing step of jetting a fluid onto the removed carpet tiles, thereby to perform cleaning for cleaning dirt and stain on the carpet tiles and to perform retexturing, thus forming cleaned and treated carpet tiles; and a recoloring step of recoloring the cleaned and treated carpet tiles with such a design or a color, or both, as to prevent or obscure non-uniformity in color, in accordance with surface conditions of the recolored carpet tiles.

3. The method according to claim 2, further comprising a step of decoloring the carpet tiles between the washing step and the recoloring step.

4. The method according to claim 2 or 3, further comprising, between the washing step and the recoloring step, a step of coating or treating the reproduced carpet tiles with at least one of a chemical agent or a coloring agent with diffusion prevention effect, which enhances clearness of surfaces of the reproduced carpet tiles.

5. The method according to claim 2, further comprising a surface treatment step of treating surfaces of the reproduced carpet tiles with at least one of a stainproof agent for preventing the reproduced carpet tiles from being stained, an antistatic agent for suppressing static electricity and a germicidal-effect agent having a germicidal effect, the surface treatment step being carried out in the recoloring step or one of steps following the recoloroing step.

6. The method according to claim 2, further comprising a bending step of bending curved reproduced carpet tiles to the original shape, in the washing step or any of the steps following the washing step.

7. The method according to claim 2, further comprising a cutting or trimming step of cutting out or trimming edge portions of the reproduced tiles, where plies have fallen, which are left after completion of the above steps.

8. The method according to claim 2, further comprising a step of decoloring the carpet tiles between the washing step and the recoloring step and further comprising a surface treatment step of treating surfaces of the reproduced carpet tiles with at least one of a stainproof agent for preventing the reproduced carpet tiles from being stained, an antistatic agent for suppressing static electricity and a germicidal-effect agent having a germicidal effect, the surface treatment step being carried out in the recoloring step or one of steps following the recoloroing step.

9. The method according to claim 2, further comprising a step of decoloring the carpet tiles between the washing step and the recoloring step and further comprising a surface treatment step of treating surfaces of the reproduced carpet tiles with at least one of a stainproof agent for preventing the reproduced carpet tiles from being stained, an antistatic agent for suppressing static electricity and a germicidal-effect agent having a germicidal effect, the surface treatment step being carried out in the recoloring step or one of steps following the recoloroing step, and further comprising, between the washing step and the recoloring step, a step of coating or treating the reproduced carpet tiles with at least one of a chemical agent or a coloring agent with diffusion prevention effect, which enhances clearness of surfaces of the reproduced carpet tiles.

10. The method according to claim 2 further comprising a step of decoloring the carpet tiles between the washing step and the recoloring step and further comprising a bending step of bending curved reproduced carpet tiles to the original shape, in the washing step or any of the steps following the washing step.

11. The method according to claim 2 further comprising a step of decoloring the carpet tiles between the washing step and the recoloring step and further comprising a bending step of bending curved reproduced carpet tiles to the original shape, in the washing step or any of the steps following the washing step and further comprising, between the washing step and the recoloring step, a step of coating or treating the reproduced carpet tiles with at least one of a chemical agent or a coloring agent with diffusion prevention effect, which enhances clearness of surfaces of the reproduced carpet tiles.

12. The method according to claim 2 further comprising a step of decoloring the carpet tiles between the washing step and the recoloring step and further comprising a bending step of bending curved reproduced carpet tiles to the original shape, in the washing step or any of the steps following the washing step and further comprising a surface treatment step of treating surfaces of the reproduced carpet tiles with at least one of a stainproof agent for preventing the reproduced carpet tiles from being stained, an antistatic agent for suppressing static electricity and a germicidal-effect agent having a germicidal effect, the surface treatment step being carried out in the recoloring step or one of steps following the recoloroing step.

13. A multi-year or multi-cycle renewable carpet system, comprising the steps of:

installing new carpet tile at a location, removing at least a portion of the carpet tile from the location after a period of use, renewing the removed carpet tile, reinstalling the renewed carpet tile at the location, removing at least a portion of the reinstalled renewed carpet tile from the location after another period of use, renewing the removed reinstalled previously renewed carpet tile, and reinstalling the twice renewed carpet tile.

14. The system as recited in claim 13, further comprising the steps of:

removing at least a portion of the reinstalled twice renewed carpet tile after another period of use, renewing the removed previously twice renewed carpet tile, and reinstalling the thrice-renewed carpet tile.

15. The system as recited in claim 13, wherein at least about 75% of the carpet tile is renewed and reinstalled at least once.

16. The system as recited in claim 13, wherein the carpet tiles are at least one of 4"×40", 36"×36", 20"×20", ×18"×18", 1 m ×1 m, and 50 cm ×50 cm.

17. The system as recited in claim 13, wherein said renewing step includes a washing/reproducing step and a recoloring step.

18. A carpet renewal and charitable donation system, comprising the steps of:

having at least a first company or organization agree to donate their used carpet tiles to a charity, having a second company or service remove the used carpet tiles, renewing the removed tiles and installing the renewed carpet tiles at the charity or at a location selected by the charity.

19. The system as recited in claim 18, wherein said renewing step includes the steps of washing and recoloring.

* * * * *